US007994918B2

(12) United States Patent
Lai et al.

(10) Patent No.: US 7,994,918 B2
(45) Date of Patent: Aug. 9, 2011

(54) METHOD AND SYSTEM FOR MONITORING ONE OR MORE OBJECTS BY ELECTRONIC DEVICE

(75) Inventors: Jia-Jiang Lai, Tu-Cheng (TW); Chih-Lung Tsan, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 254 days.

(21) Appl. No.: 12/271,936

(22) Filed: Nov. 17, 2008

(65) Prior Publication Data

US 2009/0289794 A1 Nov. 26, 2009

(30) Foreign Application Priority Data

May 21, 2008 (CN) ..... 2008 1 0301692

(51) Int. Cl.
*G08B 13/14* (2006.01)

(52) U.S. Cl. ..... 340/572.1; 340/572.4; 340/572.7; 340/572.8; 340/539.16; 340/539.32; 340/505; 340/568.1; 340/10.2; 340/10.6; 342/42; 342/44; 342/51

(58) Field of Classification Search ..... 340/572.1, 340/572.4, 572.7, 572.8, 539.16, 539.32, 340/505, 568.1, 10.2, 10.6; 342/42, 44, 51
See application file for complete search history.

(56) References Cited

U.S. PATENT DOCUMENTS

| | | | | |
|---|---|---|---|---|
| 6,483,427 | B1 * | 11/2002 | Werb | 340/10.1 |
| 7,002,473 | B2 * | 2/2006 | Glick et al. | 340/572.1 |
| 7,274,292 | B2 * | 9/2007 | Velhal et al. | 340/539.32 |
| 7,646,330 | B2 * | 1/2010 | Karr | 342/44 |
| 2005/0134459 | A1 | 6/2005 | Glick et al. | |
| 2005/0285739 | A1 | 12/2005 | Velhal et al. | |
| 2006/0038676 | A1 * | 2/2006 | Richards | 340/539.23 |

* cited by examiner

*Primary Examiner* — Tai T Nguyen
(74) *Attorney, Agent, or Firm* — Frank R. Niranjan

(57) ABSTRACT

A method and system for monitoring one or more objects by an electronic device are provided. The method includes defining a distance threshold between the electronic device and an object having a RFID tag, calculating a distance between the electronic device and the object, and generating alerts upon detecting that the distance is greater than the distance threshold.

17 Claims, 2 Drawing Sheets

METHOD AND SYSTEM FOR MONITORING ONE OR MORE OBJECTS BY ELECTRONIC DEVICE

BACKGROUND

1. Field of the Invention

Embodiments of the present disclosure relate to objects monitor, and more particularly to a method and a system for monitoring one or more objects by an electronic device.

2. Description of Related Art

Radio frequency identification (RFID) is a widely used mechanism for identifying and/or tracking items. Generally, employing RFID in the performance of such tasks requires the establishment of an RFID network, including RFID readers, in order to read RFID "tags" within the network. RFID readers emit radio waves capable of detection by RFID tags. An RFID tag is essentially a bundled microchip and antenna capable of detecting the radio waves emitted by an RFID reader and returning to the reader information stored on the microchip.

Many people have the tendency to forget their personal accessories, such as keychains, wallets, notebooks, mp3 players and so on, carelessly. For example, they may forget to bring their keychains when leaving home or they may forget to bring their notebooks when getting off the cab. Such loss represents a considerable burden of inconvenience and cost to the user.

Accordingly, a method and a system for monitoring one or more objects by an electronic device are called for in order to overcome the limitations described.

DETAILED DESCRIPTION OF CERTAIN INVENTIVE EMBODIMENTS

All of the processes described may be embodied in, and fully automated via, software code modules executed by one or more general purpose computers or processors. The code modules may be stored in any type of computer-readable medium or other storage device. Some or all of the methods may alternatively be embodied in specialized computer hardware or communication apparatus.

Figure 1:
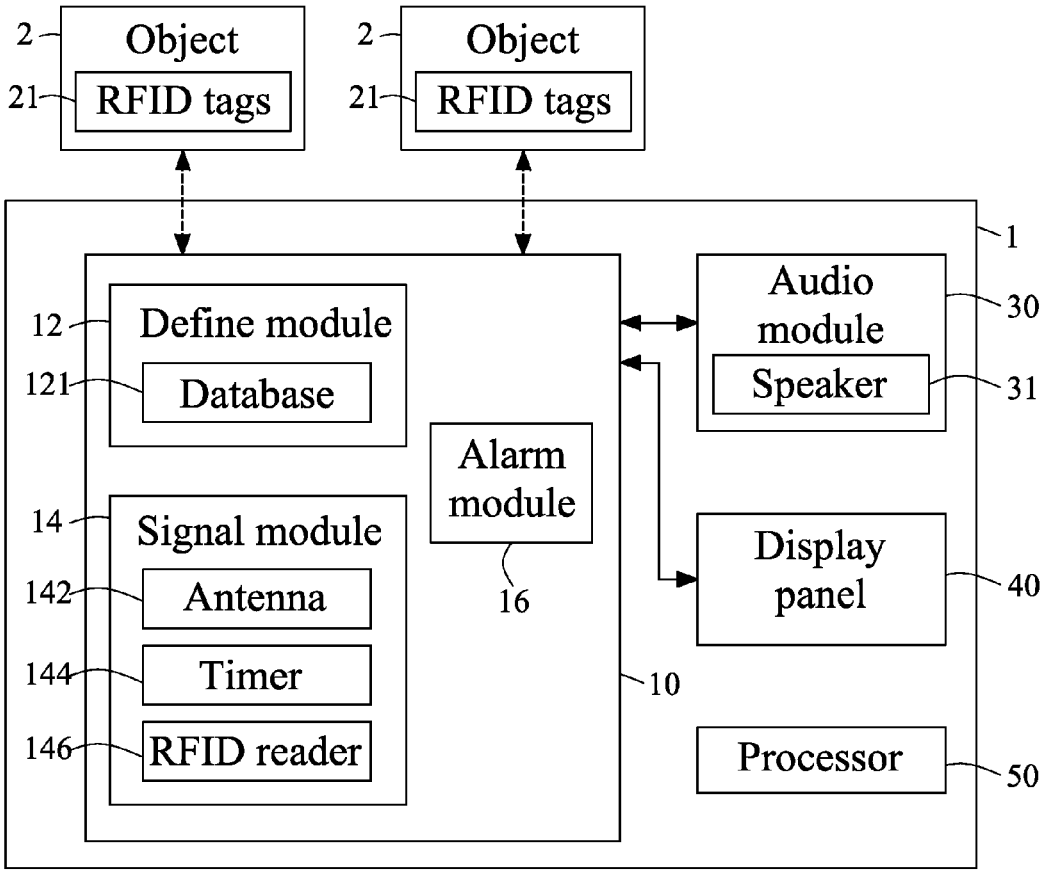
FIG. 1 is a block diagram of an embodiment of a system for monitoring one or more objects by an electronic device.

FIG. 1 is a block diagram of an embodiment of a system 10 for monitoring one or more objects (hereinafter "the system 10") by an electronic device 1. The electronic device 1, such as a mobile phone, includes an audio module 30 having a speaker 31, a display panel 40, and a processor 50 for executing the system 10 to generate notifications upon detection that an object 2, such as a keychain having a RFID tag 21 attached thereon, is out of range. Portable and non-portable electronic devices other than the mobile phone shown here, such as notebook computers and personal digital assistants (PDAs), for example, may equally utilize the system 10, without departing from the spirit of the disclosure. Other objects, such as a notebook, a mobile computer, clothes, or other objects having an RFID tag may be monitored by the system 10 without departing away from the spirit of the present disclosure.

In one embodiment, the system 10 includes a define module 12, a signal module 14 and an alarm module 16, in addition to other hardware and software components of the second electronic device 2.

The define module 12 is configured for defining a database 121 in which each of a plurality of RFID tags 21 has associated information, and the information includes a unique identification, such as characteristic data strings, and alert types including audio and video alerts, but not exclusively, associated therewith. For example, the RFID tag 21 associated with a unique identification and an audio alert may couple to a keychain.

In addition, the define module 12 is configured for defining a distance threshold between the electronic device 1 and the object 2 including the RFID tag 21 coupled thereto. For the above example, the distance threshold between the keychain and the electronic device 1 may be defined as 5 meters by the define module 12 in one exemplary example. Thus, the system 10 generates alerts upon detection that the distance between the electronic device 1 and the keychain is larger than 5 meters.

The signal module 14 is configured for radio frequency (RF) communications between the electronic device 1 and the object 2. The signal module 14 includes an antenna 142, a timer 144 and a RFID reader 146. The antenna 142 is for transmitting RF interrogation signals to the RFID tag 21 of the object 2. The RF interrogation signals are used to discern, receive, and read a plurality of passive objects 2 with the RFID tags 21 located within a RFID interrogation zone (e.g., 5 meters). Upon receipt of the RF interrogation signals, the RFID tags 21 read the information stored thereon and transmits RF signals indicative of the unique identification and the alert type of the RFID tags 21.

Upon receiving the RF signals from the RFID tags 21, the timer 144 calculates the round trip time of the RF signals between the electronic device 1 and the object 2. The RFID reader 146 is configured for identifying the RFID tag 21 by accessing the database 121 upon receipt of the RF signals indicative of the unique identification and the alert type.

The alarm module 16 is configured for calculating a distance between the electronic device 1 and the object 2 based on round trip time of the RF signals. In addition, the alarm module 16 is further configured for generating alerts upon detection that the calculated distance is greater than the distance threshold.

Upon detection that the distance between the electronic device 1 and the object 2 is greater than the distance threshold defined by the define module 12, the alarm module 16 further determines the alert type based on the RF signals transmitted by the RFID tags 21. In alternative embodiments, the database 121 is configured for storing the corresponding alert type of the RFID tags 21. Thus, the alarm module 16 determines the alert type of RFID tags 21 by accessing the database 121 with the unique identification of the RFID tags 21.

In the embodiment, the alert types include audio alerts and graphic alerts. It is to be noted that, while audio and graphic alerts are described here, the system and method of the disclosure can utilize any other type of notification, including but not limited to vibration of the unit and electronic transmission of the alert, while remaining well within the scope of the disclosure, without deviating from the spirit of the present disclosure.

Upon a determination of the audio alert, the alarm module 16 generates and transmits the audio alert to the audio module 30 of the electronic device 1 so as to display the audio alert by the speaker 31.

Upon the determination of the graphical alert, the alarm module 16 generates and transmits the graphic alert to the display panel 40 so as to display the graphical alert on the display panel 40.

Figure 2:
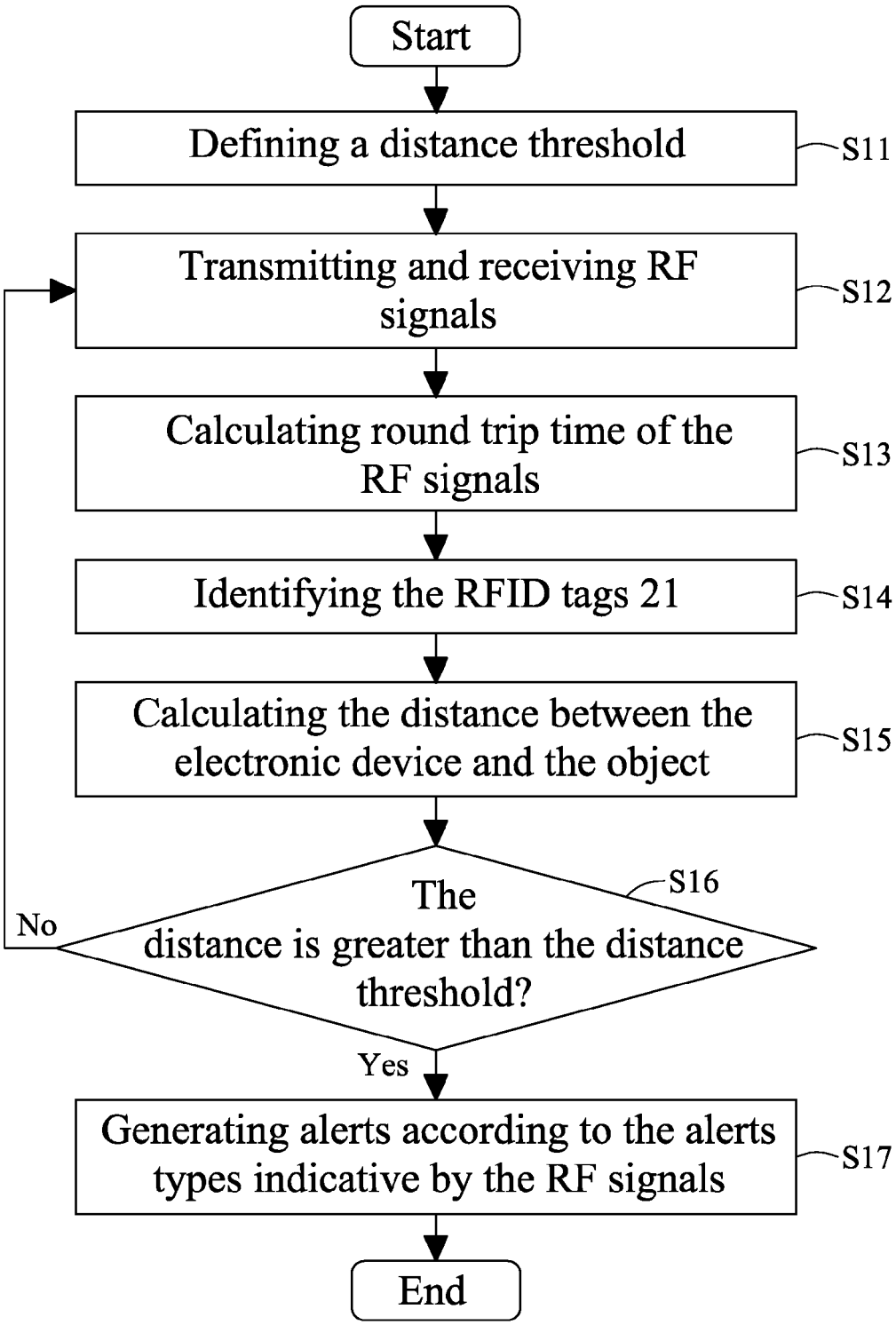
FIG. 2 is a flowchart of an embodiment of a method for monitoring one or more objects by an electronic device.

FIG. 2 is a flowchart of an embodiment of a method for monitoring one or more objects by the electronic device 1. The method of FIG. 2 may used for generating notifications upon detection that an accessory is out of range. Depending on the embodiment, additional blocks may be added or deleted and the blocks may be executed in order other than that described.

In block S11, the define module 12 defines a distance threshold between the electronic device 1 and the object 2 having the RFID tag 21 coupled thereto. In block S12, the signal module 14 processes RF signals communications, such as transmitting and receiving RF signals, between the electronic device 1 and the object 2.

In block S13, the timer 144 of the signal module 14 calculates round trip time of the RF signals between the electronic device 1 and the object 2.

In block S14, the timer RFID reader 146 identifies the RFID tags 21 by accessing the database 121 upon receipt of the RF signals indicative of the unique identification and the alert type.

In block S15, the alarm module 16 calculates the distance between the electronic device 1 and the object 2 based on the round trip time of the RF signals.

In block S16, the alarm module 16 determines whether the distance is greater than the distance threshold. If the distance is greater than the distance threshold, in block S17, the alarm module 16 generates alerts according to the alert type indicated by the RF signals sent from the RFID tag 21. Otherwise, the process goes back to block S12 to repeat the above-mentioned processing.

It should be emphasized that the described inventive embodiments are merely possible examples of implementations, and set forth for a clear understanding of the principles of the present disclosure. Many variations and modifications may be made to the above-described inventive embodiments without departing substantially from the spirit and principles of the present disclosure. All such modifications and variations are intended to be included herein within the scope of this disclosure and the above-described inventive embodiments, and the present disclosure is protected by the following claims.

What is claimed is:

1. A monitoring system for monitoring one or more objects by an electronic device, the system comprising:

a define module for defining a distance threshold between the electronic device and the one or more objects comprising a radio frequency identification (RFID) tag, the RFID tag comprising associated information of the corresponding one or more objects;

a signal module for radio frequency (RF) communications with the one or more objects by transmitting RF signals to the RFID tag of the one or more objects and by receiving corresponding RF signals from the RFID tag of the one or more objects, the signal module further comprising a timer; and an alarm module for calculating a distance between the electronic device and the one or more objects based on a round trip time of the corresponding RF signals calculated by the timer of the signal module, and for generating monitoring alerts upon detection that the distance is greater than the distance threshold.

2. The system as claimed in claim 1, wherein the define module is configured for defining the associated information of the RFID tag, the associated information comprising a unique identification and alert type and is stored in a database of the monitoring system.

3. The system as claimed in claim 2, wherein the electronic device comprises an audio module comprising a speaker electrically coupled to the alarm module, the alarm module further configured for generating and transmitting an audio alert to the audio module according to the alert type to display the audio alert by the speaker.

4. The system as claimed in claim 2, wherein the electronic device comprises a display panel electrically coupled to the alarm module, the alarm module further configured for generating and transmitting a graphical alert to the display panel according to the alert type to display the graphical alert on the display panel.

5. The system as claimed in claim 2, wherein the signal module comprises an antenna for conducting the RF communications between the monitoring system and the one or more objects.

6. The system as claimed in claim 5, wherein the signal module further comprises a RFID reader configured for identifying the RFID tag by accessing the database upon receipt of the RF signals from the one or more objects.

7. A computer-implemented method for monitoring one or more objects by an electronic device, the method comprising:

defining a distance threshold between the electronic device and one or more objects comprising a RFID tag;

transmitting RF interrogation signals to the RFID tag of the one or more objects;

receiving the RF signals indicative of associated information of the RFID tag;

calculating a distance between the electronic device and the one or more objects basing on a round trip time of the RF signals by a timer of the electronic device; and generating monitoring alerts upon detecting that the distance is greater than the distance threshold.

8. The method as claimed in claim 7, wherein the associated information of the RFID tag comprises a unique identification and an alert type of the one or more objects and are stored in a database.

9. The method as claimed in claim 8, wherein after the generating step, the method further comprises:

transmitting an audio alert to an audio module of the electronic device to display the audio alert upon determining that the alerts type is the audio alert; and transmitting a graphic alert to a display panel of the electronic device to display the graphic alert upon determining that the alerts type is the graphic alert.

10. The method as claimed in claim 8, wherein the receiving step further comprises:

identifying the RFID tag by accessing the database upon receipt of the RF signals from the one or more objects.

11. The method as claimed in claim 7, wherein the RF signals are transmitted and received by an antenna.

12. A computer-readable medium for monitoring one or more objects, the computer-readable medium having stored thereon instructions that, when executed by an electronic device, cause the electronic device to:

define a distance threshold between the electronic device and one or more objects comprising a RFID tag;

transmit RF interrogation signals to the RFID tag of the one or more objects;

receive the RF signals indicative of associated information of the RFID tag;

calculate a distance between the electronic device and the one or more objects basing on round trip time of the RF signals by a timer of the electronic device; and generate monitoring alerts upon detecting that the distance is greater than the distance threshold.

13. The computer-readable medium in claim 12, wherein the associated information of the RFID tag comprises a unique identification and an alert type of the one or more objects and are stored in a database.

14. The computer-readable medium in claim 13, wherein the generating monitoring alerts further comprises:

transmit an audio alert to an audio module of the electronic device to display the audio alert upon determining that the alerts type is the audio alert; and transmit a graphic alert to a display panel of the electronic device to display the graphic alert upon determining that the alerts type is the graphic alert.

15. The computer-readable medium in claim 13, wherein the receiving the RF signals further comprises:

identifying the RFID tag by accessing the database upon receipt of the RF signals from the one or more objects.

16. The computer-readable medium in claim 12, wherein the RF signals are transmitted and received by an antenna.

17. The computer-readable medium in claim 12, wherein the round trip time of the RF signals between the electronic device and the one or more objects is calculated by a timer.

* * * * *